United States Patent [19]

Kilmer

[11] 4,411,190

[45] Oct. 25, 1983

[54] ENERGY TRANSLATION DEVICE HAVING INDIVIDUALLY COMPENSATED SLIDING VALVES AND COUNTERBALANCING MECHANISM

[76] Inventor: John B. Kilmer, 9030 Maple, Wichita, Kans. 67209

[21] Appl. No.: 261,043

[22] Filed: May 7, 1981

[51] Int. Cl.[3] ..... F01B 1/06; F16K 25/02

[52] U.S. Cl. ..... 91/487; 91/491; 91/495; 137/625.2; 251/172

[58] Field of Search ..... 91/486, 487, 491, 492, 91/495; 137/625.2, 625.25; 251/172; 418/61 R

[56] References Cited

U.S. PATENT DOCUMENTS

| | | | |
|---|---|---|---|
| 448,607 | 3/1891 | Gollings . | |
| 1,414,965 | 5/1922 | Mayer . | |
| 2,423,507 | 7/1947 | Lawton . | |
| 2,545,315 | 3/1951 | Sproull . | |
| 2,716,944 | 9/1955 | Ferris | 91/491 |
| 2,725,182 | 11/1955 | Spriggs . | |
| 2,989,951 | 6/1961 | Charlson . | |
| 3,040,716 | 6/1962 | Hahn | 91/492 |
| 3,215,043 | 11/1965 | Huber . | |
| 3,339,460 | 9/1967 | Birdwell | 91/491 |
| 3,391,608 | 7/1968 | Huber . | |
| 3,443,378 | 5/1969 | Monroe et al. . | |
| 3,490,383 | 1/1970 | Parrett . | |
| 3,516,765 | 6/1970 | Boyadjieff et al. . | |
| 3,613,510 | 10/1971 | Chambers . | |
| 3,696,710 | 10/1972 | Ortelli | 91/487 |
| 3,796,525 | 3/1974 | Kilmer | 91/491 |
| 3,913,454 | 10/1975 | Nelson | 91/491 |
| 3,942,414 | 3/1976 | Eddy | 91/487 |
| 4,074,615 | 2/1978 | Avery | 91/492 |

FOREIGN PATENT DOCUMENTS

| | | |
|---|---|---|
| 392327 | 3/1924 | Fed. Rep. of Germany . |
| 980766 | 1/1951 | France . |
| 202323 | 4/1939 | Switzerland . |

*Primary Examiner*—John J. Vrablik

*Attorney, Agent, or Firm*—Schmidt, Johnson, Hovey & Williams

[57] ABSTRACT

Improved energy translation devices, such as fluid motors or pumps of the type including an orbiter member operatively coupled between a stator and a rotor, are disclosed which include an individually pressure compensated valving arrangement, telescopically interfitted piston elements having spherical, pressure loaded sealing ends, and a unique counterbalancing mechanism. The valving arrangement has a pair of intercommunicated, freely laterally movable valve bodies adjacent each fluid displacement piston assembly and respectively on opposite sides of the orbiter; each body includes especially designed, opposed fluid chambers therein for receiving pressurized fluid and individually urging each pair of bodies toward the central orbiter to establish a sliding seal with the orbiter and a desired amount of lubricating leakage of fluid adjacent the valve bodies. The respective fluid displacement piston assemblies are advantageously carried between the orbiter and a central shaft, and are formed of relatively shiftable, biased apart tubular pieces each having spherical ends; the respective ends are in mating engagement with complementary structure on the central shaft and the orbiter itself, to achieve a pressure loaded, sliding seal for the piston assemblies. The counterbalancing mechanism includes a differentially weighted, rotatable counterbalancer coupled to the orbiter so that the respective centers of gravity thereof are maintained 180 degrees apart during operation of the device.

18 Claims, 8 Drawing Figures

ENERGY TRANSLATION DEVICE HAVING INDIVIDUALLY COMPENSATED SLIDING VALVES AND COUNTERBALANCING MECHANISM

BACKGROUND OF THE INVENTION

1. Field of the Invention

The present invention is concerned with improved energy transmission devices such as fluid-mechanical and mechanical-fluid motors, pumps and certain actuators, meters and couplers. More particularly and in one preferred aspect of the invention, energy translation devices of the type disclosed in U.S. Pat. No. 3,796,525 are described, which are improved by provision of an individually compensated valving arrangement, fluid displacement piston assemblies having enhanced sealing properties, and a counterbalancing mechanism which produces a centrifugal force equal to, but in the opposite direction, to the centrifugal force generated by the orbiter member of the unit. In view of the foregoing, U.S. Pat. No. 3,796,525 is incorporated by reference herein.

2. Description of the Prior Art

In its particular aspects, the present invention pertains to devices of the general class which employ a pair of relatively rotatable machine elements in combination with an intermediate orbital member coupled therebetween. Such devices assume a variety of forms, such as those described in the following patents: U.S. Pat. Nos. 3,215,043, 3,391,608, 3,490,383, 3,516,765, 448,607, 3,613,510, 2,989,951, 3,443,378, 2,423,507 and 3,796,525, French Patent No. 980,766, Swiss Patent No. 202,323 and German Patent No. 392,327.

Although units of the above type have achieved widespread usage, certain problems remain. For example, in one type of known device, the orbiting member carries a plurality of spaced apart piston and cylinder assemblies, and the orbiter is slotted adjacent each assembly for purposes of delivery and return of hydraulic fluid to the piston assemblies. These slots, due to the orbital motion of the member, are alternately connected to pressure and exhaust slots in the main frame. In addition, the orbiter in this device floats laterally between a frame and back plate. Accordingly, the spaced apart valving slot in the gear must be relatively wide to present a large effective area and accommodate the movement of the orbiter. This in turn results in the generation of relatively high hydraulic forces (particularly during high pressure operations) which serve to push the backplate away from the frame, and results in increased clearance between the frame and orbiting member. This can cause excessive leakage at the region of the valving slots. It is to be understood in this respect that a certain minor amount of leakage at these areas is required for good lubrication; however, excessive leakage lowers the efficiency of the device. Therefore, the problem has been to design for proper fluid leakage which is substantially constant and largely independent of operational pressure.

Another problem heretofore present in certain orbiter devices stems from undue friction and wear of the piston and cylinder assemblies, and the general complexity of these assemblies. That is to say, the piston and cylinder units are necessarily subjected to varying pressures during operation, and it has therefore been difficult to properly seal the same against excessive fluid leakage while at the same time avoiding large mechanical loadings and consequent undue friction and wear at the sealing areas. Thus, the designer has heretofore been faced with a seemingly irreconcilable dilemma between proper sealing and extreme wear, and has been forced to make undesirable design compromises.

Finally, in any device utilizing an oribiting member there is inherently a mechanical imbalance, which under dynamic conditions produces a mechanical vibration. This vibration results from centrifugal forces which are proportional to the weight of the orbiting member multiplied by the radius of the orbit (which is in turn equal to the eccentricity of the orbiter's path). This vibration can be undesirable, especially in large devices and at higher operational speeds.

SUMMARY OF THE INVENTION

The present invention overcomes the problems outlined above and provides a greatly improved fluid-mechanical energy translation device. In one aspect of the invention, a shiftable member (such as an orbiting gear) is coupled between relatively movable elements (e.g., a stator and a rotor) and carries a plurality of fluid pressure actuatable displacement assemblies. An individually pressure compensated valving system having a pair of opposed, cooperating valve bodies for each assembly and respectively disposed adjacent the opposed faces of the shiftable member is also included. One body of each pair thereof is in operative communication with fluid input and exhaust slots in a stationary frame, whereas the other body is a "dummy" in fluid communication with the first valve body for purposes of pressure force equalization on the central member. The bodies are each mounted for movement toward and away from the central member, and include means serving to constantly urge the bodies toward the central member for ensuring proper valve sealing and fluid leakage. In practice each valve body is provided with three pairs of intercommunicated chambers for pressure equalization, with coordinated pressure reactive areas provided such that the net hydraulic force acting on the bodies urges them toward the obiter member. The three pairs of chambers of each body are advantageously communicated through respective slots in the central member, in order to equalize the sideways pressure exerted on the member. The associated chamber pairs are respectively employed to individually compensate the three pressures experienced at the valve regions of the member, namely, displacement chamber pressure, the pressure existing at the fluid input or pressure opening, and the pressure existing at the fluid output or exhaust opening. Moreover, by virtue of the individual and independent mounting of the bodies, pressure compensation is automatically achieved and instantaneously adjusted at all valving regions of the shiftable member.

Another feature of the invention involves the use of improved fluid displacement piston and cylinder assemblies which are carried by the central orbiter member. Each of these assemblies includes a pair of telescopically interfitted elements cooperatively defining therebetween a fluid chamber, with each of the elements presenting a substantially spherical endmost sealing region remote from the other element. Corresponding spherical sealing areas are defined at the inner and outer regions where the elements are installed, i.e., on the orbiter itself and on a central main shaft. The interfitted elements are located between the sealing areas, with the endmost spherical sealing regions thereon respectively in a mating, sliding seal engagement. Each of the elements presents an internal effective pressure reactive area oriented for urging the elements apart when the fluid chamber is filled with a pressurized hydraulic fluid. The effective areas of each of the endmost spherical regions are less than the corresponding effective engagement areas of the associated elements, so that a desired net pressure loading sealing force is developed at both ends of the piston assemblies.

Finally, in yet another aspect of the invention, a differentially weighted counterbalancer is mounted within the device for rotation thereof in synchronism with the orbiting member such that the center of gravity of the counterbalancer is maintained 180 degrees from the center of gravity of the member during movement of the latter. The counterweight is differentially weighted with a lightweight and a heavyweight material so as to produce an unbalance therein exactly equal to the unbalance of the orbiting member. This in turn produces a centrifugal force equal to, but in the opposite direction, to the centrifugal force produced by the orbiting member. In addition, the counterbalancer is constructed to be symmetrically round with respect to its rotational axis so that it does not churn (pump) the fluid filling the internal structure of the device.

DESCRIPTION OF THE PREFERRED EMBODIMENT

Figure 1:
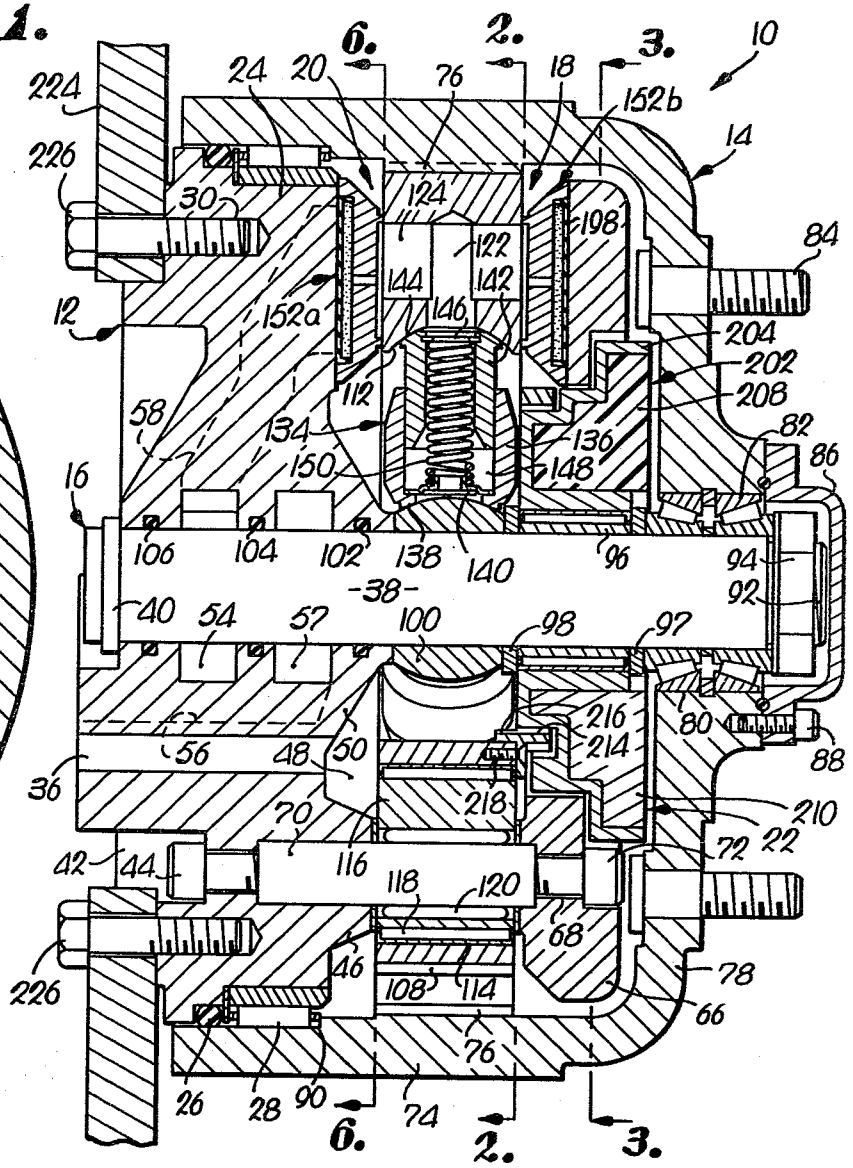
FIG. 1 is a vertical sectional view of an energy translation device in accordance with the invention.

Turning now to the drawings, an energy translation device 10 in accordance with the invention broadly includes a stationary frame 12, a rotatable hub assembly 14 mounted for rotation on a central shaft unit 16, an orbiter gear 18 interposed between frame 12 and hub assembly 14 and operatively coupled to the same, a pressure compensated valving assembly broadly referred to by the numeral 20, and a counterbalancing mechanism 22.

Figure 8:
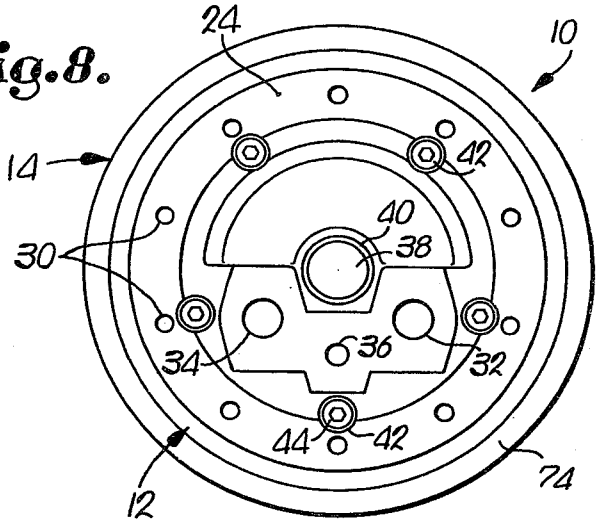
FIG. 8 is a rear elevational view of the device depicted in FIG. 1.

In more detail, the frame 12 includes a plate 24 provided on the outer periphery thereof with a circular fluid seal 26 and a roller bearing assembly 28. The rear or exterior face of plate 24 (see FIG. 8) is provided with a plurality of circumferentially spaced, threaded bores 30 therein, as well as an inlet and an outlet port 32 and 34, and a fluid return port 36. The plate 24 is centrally apertured and receives a main, stationary central shaft 38 forming a part of shaft unit 16, with shaft 38 held in place by means of snap ring 40. Finally, the plate 24 is apertured as at 42 for receiving corresponding cap screws 44, the function of which will be described hereinafter.

The interior face of plate 24 is provided with a plurality of five outwardly projecting, somewhat frustoconical extensions 46 which surround and partially define an annular fluid return passageway 48 which is in communication with the port 36. The central region of the internal face of plate 24 is provided with an outwardly projecting portion 50 which is centrally bored for receiving shaft 38, as best seen in FIG. 1.

Figure 6:
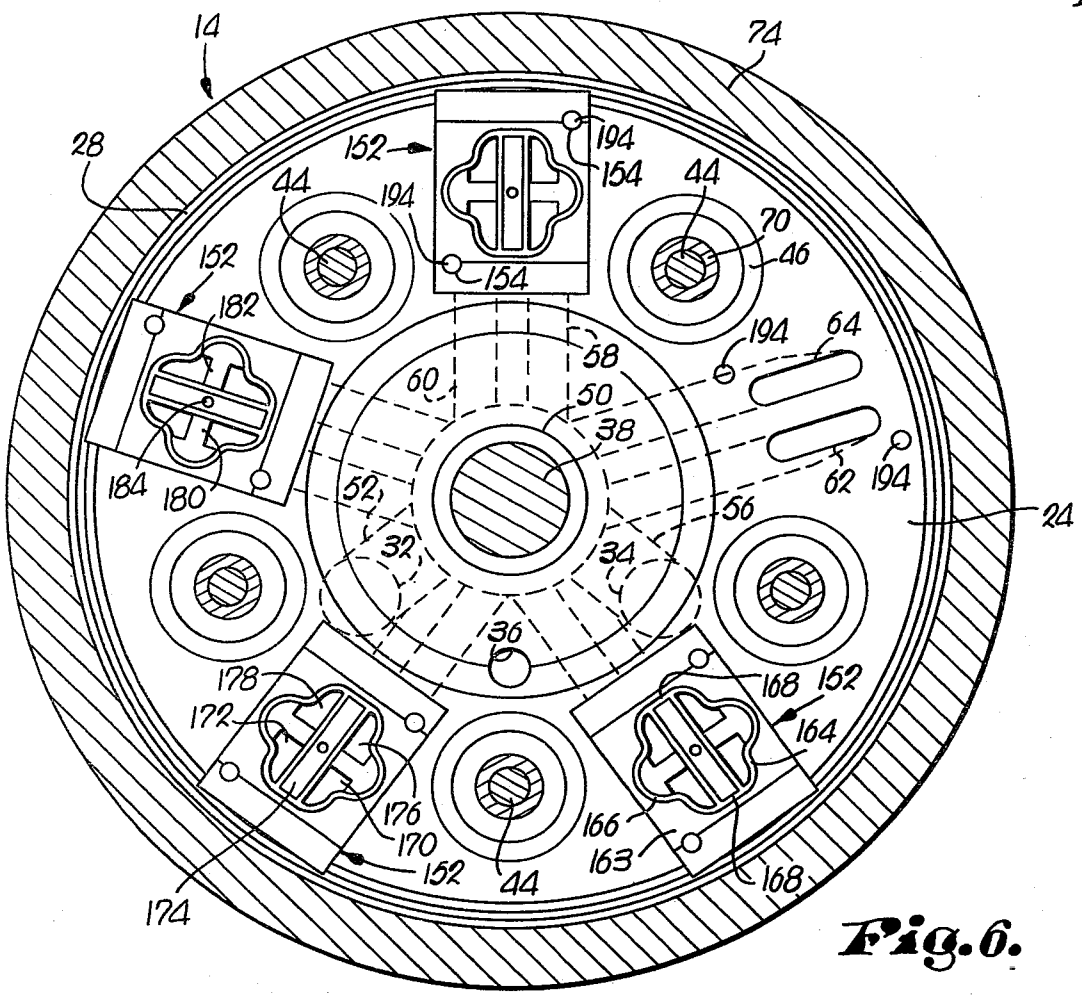
FIG. 6 is a sectional view taken along line 6—6 of FIG. 1, with the fluid passageways provided in the stationary frame being depicted in phantom.

Referring now to FIGS. 1 and 6, it will be seen that inlet port 32 is in communication with an internal bore 52 within plate 24 and leading to an annular zone 54 about shaft 38. In like manner, the outlet port 34 is communicated via an internal bore 56 with a similar annular zone 57 about shaft 38 and spaced from zone 54. The annular zones 54, 57 are in turn communicated with respective, radially outwardly extending input and exhaust fluid passageways. Specifically, the plate 24 is manufactured to present a plurality of five circumferentially spaced, generally radially extending inlet or pressurized fluid passageways 58 which are each in communication with the corresponding zone 54. In a similar manner, a total of five circumferentially spaced output or exhaust fluid passageways 60 extend between and are communicated to the associated annular zone 57. The passageways 58, 60 are arranged in associated sets or pairs thereof as best seen in FIG. 6, with each corresponding pair being located between an adjacent pair of extensions 46. The respective passages 58, 60, of each set terminate in corresponding pressurized fluid outlet openings 62 and exhaust fluid openings 64.

The frame further includes a stationary, annular plate 66 spaced from the plate 24. Plate 66 is provided with a series of circumferentially spaced apertures 68 therethrough which are aligned with the apertures 42 through the plate 24. Plate 66 is maintained in its proper spaced relationship to plate 24 by means of a series of tubular, internally threaded members 70 which are respectively received within the apertures 42 and 68 (see FIG. 1), and by means of the cap screws 44 and cap screws 72. The screws 72 are disposed within the aperture 68 and threaded into the member 70 as depicted.

The hub assembly 14 includes a somewhat tubular ring gear portion 74 provided with a series of gear teeth 76 circularly arranged on the internal surface thereof; and an outer cover portion 78 is secured to the ring gear portion 74. The cover portion 78 includes a central aperture 80 housing a roller bearing 82 which engages shaft 38, as well as a plurality of circumferentially spaced studs 84 disposed about the central aperture 80. A cap 86, held in place by screws 88, completes the cover portion 78. It will be observed from a study of FIG. 1 that ring gear portion 74 is relieved as at 90 (i.e., adjacent the outer periphery of plate 24) to provide a bearing surface for engagement with the roller bearing assembly 28.

The shaft unit 16 includes the central, elongated shaft 38 which extends through the centrally apertured projection 50 of plate 24, and also through the center of stationary backing plate 66 and roller bearing 82 associated with hub assembly 14. The outermost end of shaft 38 remote from plate 24 is threaded as at 92, and a locking nut 94 is employed for securing the various elements in place along shaft 38. Finally, it will be observed that a roller bearing 96 is operatively disposed on shaft 38 inboard of roller bearing 82, along with annular spacers 97 and 98 and an outwardly projecting, arcuate ring 100 which abuts the outermost face of projection 50. The purpose of ring 100 will be explained hereinafter. Finally, a plurality of seals 102, 104 and 106 are disposed about shaft 38 and received in corresponding recesses in the plate 24, in order to provide a fluid seal at the regions of the annular zones 54 and 57.

Figure 2:
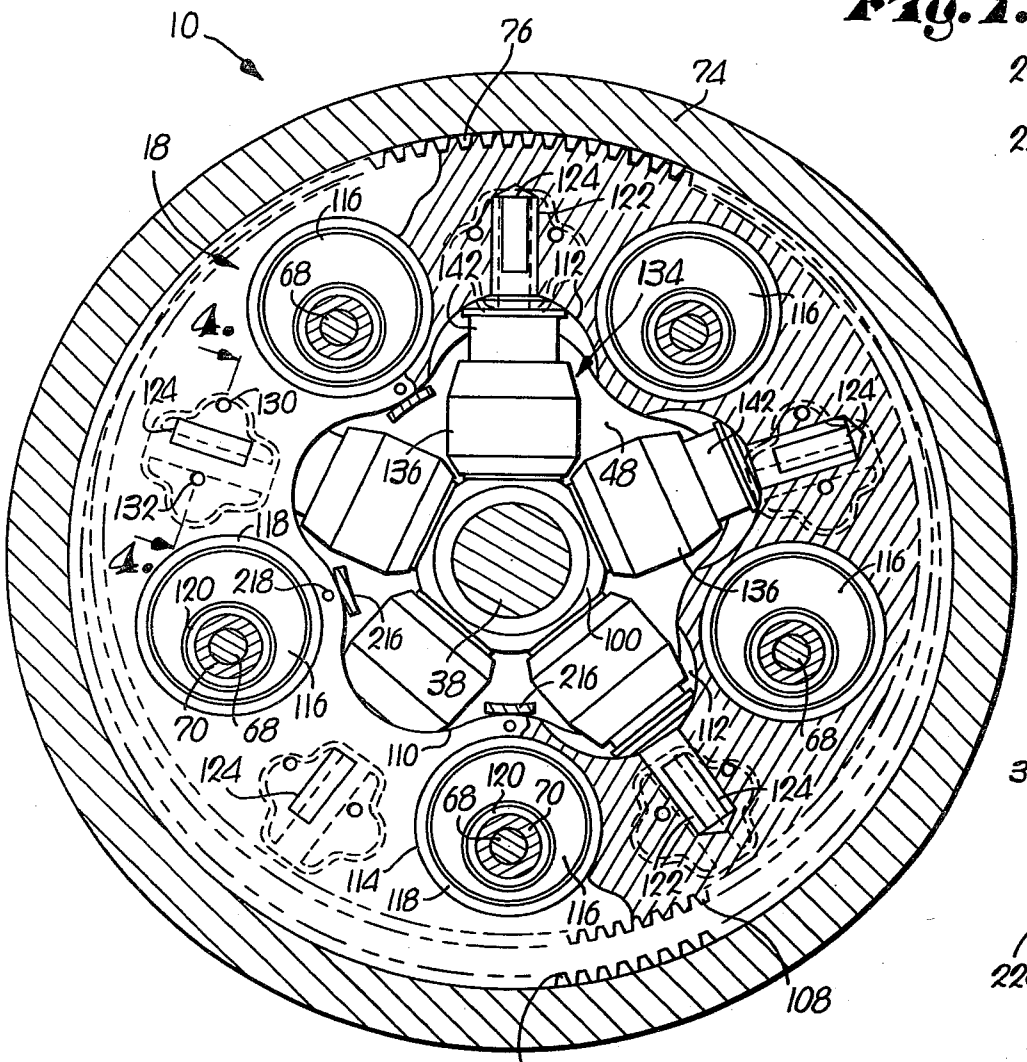
FIG. 2 is a sectional view taken along line 2—2 of FIG. 1.

Orbiter gear member 18 is of overall circular configuration having a diameter less than that of the ring gear portion 74. The member 18 is provided with a plurality of outermost peripheral gear teeth 108 designed to mesh with teeth 76 on ring gear portion 74. As is usual in epicyclic gear structures of this type, the number of teeth 108 is less than the number of teeth 76, but the respective teeth sets are appropriately shaped for proper mesh and transmission of driving force. In effect, a mechanical transmission or coupling is provided by the teeth 76, 108. The member 18 is configured to present a somewhat pentagonal central opening 110 therethrough having a series of five spaced apart, internally facing bearing areas 112 each of frustospherical, convex configuration. In addition, a total of five, relatively large circular openings 114 are provided through the member 18 between respective pairs of bearing areas 112. These openings 114 receive corresponding eccentric bushings 116 which have respective outer and inner bearings 118, 120 associated therewith. As best seen in FIGS. 1 and 2, the bushings are bored in an off center relation and receive the corresponding shafts 70 located between the plates 24, 66 for movement relative to the shafts. The eccentricity of the bushings 116 is designed to permit exactly the range of orbital movement of the member 18 needed to bring the teeth 108 and 74 into proper meshing, force transmitting relationship during the operation of device 10. In addition, the openings 114 are preferably sized to permit lateral, back-and-forth movement of the member 18 between the plates 24 and 66 during operation, so that the member can "float."

Figure 4:
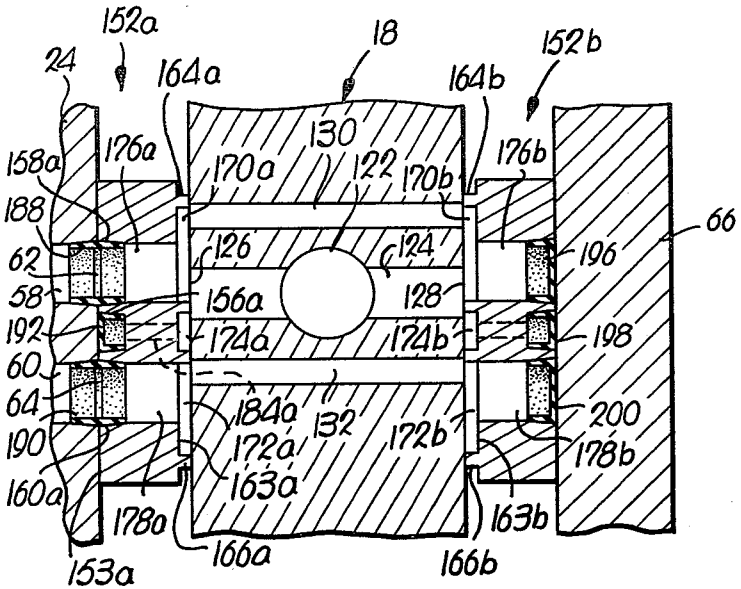
FIG. 4 is an enlarged, sectional, fragmentary view taken along line 4—4 of FIG. 2 and illustrating the details of construction of a dual body, pressure compensated, sliding valve assembly in accordance with the invention.

Referring now to FIGS. 1 and 4, it will be seen that the orbiter 18 is provided with a total of five radially extending, elongated bores 122 respectively communicating with a corresponding bearing area 112. Each bore 122 is in communication with a laterally extending slot 124 which extends completely through the orbiter 18 and terminates in respective slot openings 126 and 128. Finally, a pair of fluid passageways 130 and 132 extend between and through the opposed faces of the member 18, and are respectively located on opposite sides of the slot 124.

In the embodiment illustrated, a total of five piston and cylinder assemblies 134 are operatively coupled to the orbiter 18. It will be understood in this regard though, that as few as three such units can be employed if desired. Each assembly 134 includes an outer, tubular telescopic member 136 which has an innermost, concave, substantially frustospherical sealing region 138, as well as a spring mount 140 adjacent the inner end thereof. In addition, an inner tubular member 142 is provided which is telescopically interfitted within and shiftable relative to the outer member 136. The outermost end of the member 142 is in the form of a frustospherical sealing region 144, and a spring-engaging ring 146 is located within the tubular bore thereof. The members 136 and 142 cooperatively present an internal displacement chamber 148, and are biased apart by means of a coil spring 150 situated within the assembly and operatively engaging the mount 140 and ring 146.

The respective piston and cylinder assemblies 134 are mounted between and engage the outermost periphery of the shaft-mounted ring 100 and the respective bearing areas 112 on the orbiter 18. It will be observed that the sealing region 138 is of concave configuration and slidingly mates with the convex, frustospherical outer periphery of the ring 100. By the same token, the convex sealing region 144 on the member 142 mates with the associated bearing area 112.

In preferred forms, the effective internal pressure reactive area of each of the members 136, 142 is slightly larger than the effective areas of the regions 138 and 144. Thus, when the chamber 148 is filled with hydraulic fluid under pressure, a pressure loaded force is obtained on the spherical seals formed at the ends of the members 136, 142.

Figure 7:
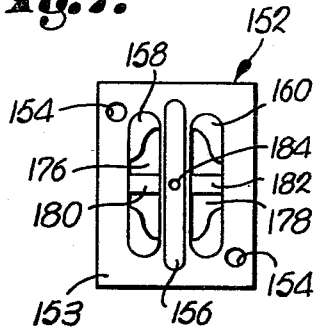
FIG. 7 is an elevational view illustrating a valve body used in the device of the invention.

The pressure compensated valving assembly 20 includes a pair of valve bodies 152 (see FIG. 7) respectively located adjacent each slot 124 and disposed adjacent the opposed faces of the member 18. The body 152 is of substantially rectangular configuration and includes a pair of diagonally spaced, dowel pin-receiving apertures 154 at the corners thereof. The face 153 of body 152 designed to be remote from the orbiter 18 is configured to present an elongated depression 156 therein, as well as a pair of identical depressions 158, 160 on opposite sides of the depression 156.

The face 163 of each block 152 designed to be adjacent the orbiter 18 (see FIG. 6) includes a pair of narrow, projecting lands 164 and 166 of somewhat hat-shaped configuration which are joined by short land segments 168. The respective lands 164, 166 surround and partially define respective pressure and exhaust cavities 170, 172, whereas the elongated straight portions of lands 164, 166, as well as the segments 168, cooperatively surround and partially define a central cavity 174. An irregularly shaped bore 176 extends between and communicates depression 158 and cavity 170, and a similar bore 178 communicates depression 160 and cavity 172. A pair of laterally extending reinforcing web members 180, 182 are respectively located within the bores 176, 178. Finally, a central fluid passageway 184 extends between and communicates depression 156 and cavity 174.

Referring now specifically to FIG. 4, the orientation of a pair of bodies 152 forming one of the individually pressure compensated sliding valves will be explained. For ease of discussion, the body 152 located between plate 24 and orbiter 18 will be referred to as valve body **152*a*, whereas the corresponding, opposed body between the orbiter and plate 66 will be referred to as valve body 152*b*. In like manner, the respective depressions, cavities, bores and passageways will be denominated with appropriate "a" or "b" suffixes. Accordingly, it will be seen that the valve body 152*a* is located with its face 153*a* in engagement with plate 24. In addition, the adjacent inlet or pressurized fluid opening 62 in plate 24 is in alignment with the depression 158*a* and communicating bore 176*a*. An elongated, ovalshaped, tubular elastomer seal 188 is interposed within the passageway 58 and depression 158*a* as illustrated, in order to maintain a fluid tight, yet slidable seal. In like manner, the depression 160*a* and associated communicating bore 178*a* are in communication with outlet or exhaust passageway 60 and opening 64 in plate 24. Here again, an oval-shaped, tubular elastomer seal 190 is located at the junction of opening 64 in depression 160***a* to provide a slidable seal.

A U-shaped in cross-section elastomer seal 192 is located within central depression 156*a* as depicted, so as to create a fluid chamber and seal the latter from communication with plate 24.

The block 152*a* is mounted for back-and-forth movement relative to the orbiter 18 by means of dowel pins 194 received within the apertures 154. It will be therefore observed that the body 152*a* can shift back-and-forth laterally as viewed in FIG. 4 without creating a fluid leakage at the juncture between face 153*a* and plate 24.

At face 163*a* of body 152*a*, the inlet cavity 170*a* (which is in communication with bore 176*a*), is in constant communication with the fluid passageway 130 throughout the entire range of movement of orbiter 18. Similarly, the passage 132 is in constant communication with the exhaust cavity 172*a*. Finally, the central cavity 174*a* is in constant communication with the slot 124. The importance of these fluid communication relationships will be made clear hereinafter.

Body 152*b* is, insofar as its specific construction is concerned, identical with body 152*a*. However, the body 152*b* is employed as a so-called "dummy" valve for pressure compensation purposes. Accordingly, three elongated, U-shaped elastomer seals 196, 198 and 200 are located within the depressions 158*b*, 156*b*, and 160*b*. As illustrated, the elastomers are oriented so as to create fluid chambers and seal off their associated depressions from communication with the adjacent face of plate 66. Here again however, the body 152*b* is mounted for back-and-forth sliding movement relative to the orbiting gear 18 by means of dowel pins 194 received within the apertures 154; and the depressions are sealed at the face of block 152*b* remote from orbiter 18. Finally, just as in the case of the body 152*a*, cavity 170*b* is in constant fluid communication with passage 130; cavity 172*b* is in constant communication with passage 132; and cavity 174*b* is in constant communication with the slot 124.

When the bodies 152*a*, 152*b* are oriented as depicted in FIG. 4, it will be observed that three separate fluid chambers are defined at the interface between the gear 18 and each adjacent body. Specifically, and referring for example to body 152*a*, an inlet or pressurized fluid chamber is defined by cavity 170*a* and the adjacent gear face; an exhaust chamber is defined by cavity 172*a* and the adjacent gear face; and a third neutral or central chamber in communication with the associated piston assembly is defined by the cavity 174*a* and the orbiter face. It will further be appreciated that each of these chambers is in constant fluid communication with an associated, generally opposed fluid chamber within the body 152*a* and presented by the depressions 158*a*, 160*a* and 156*a*. Hence, the pressures with the respective depressions of each value body are equal to the pressure within their related chambers, at all system pressures throughout the operation of device 10.

Each body 152*a* is constantly and independently urged toward member 18 during operation of device 10 by virtue of the fact that the effective pressure reactive areas of the depressions 156*a*–160*a* are slightly greater than the effective pressure reactive area of the associated chambers 170*a*–174*a*. Therefore, three differential hydraulic forces are developed which are directly proportional to the instantaneous system pressures extant within each mated pair of interconnected depressions and chambers. Also, the leakage rate at the interface between the lands 164*a*, 166*a* and the adjacent member face is roughly proportional to the instantaneous system pressure. The net result is a leakage rate across the lands 164*a*, 166*a* which is substantially constant for varying system pressures. This same relationship holds for the body 152*b*, so that, during operation of device 10, the respective bodies 152*a* and 152*b* are urged toward member 18 under the influence of equal, but oppositely directed net forces, and with essentially constant and equal leakage rates.

Counterbalancing mechanism 22 includes a differentially weighted counterbalancer 202 of generally circular configuration which is mounted for rotation about the roller bearing 96 supported by shaft 38. The counterbalancer includes an irregularly shaped shell 204 having a central divider 206. One-half of the shell is filled with a lightweight synthetic resin material as at 208, whereas the other portion of the shell is filled with a heavy material such as lead, as at 210. The counterweight 202 is mounted for rotation about shaft 38 in synchronism with the orbital member 18 in order to produce an unbalance exactly equal to the unbalance attributable to the orbiting of member 18. In this way a centrifugal force is created which is equal, but in an opposite direction, to the centrifugal force produced by the orbiting member 18. In practice, this is accomplished by maintaining the center of gravity of the counterbalance 202 180 degrees from the center of gravity of the member 18 during movement of the latter.

Figure 3:
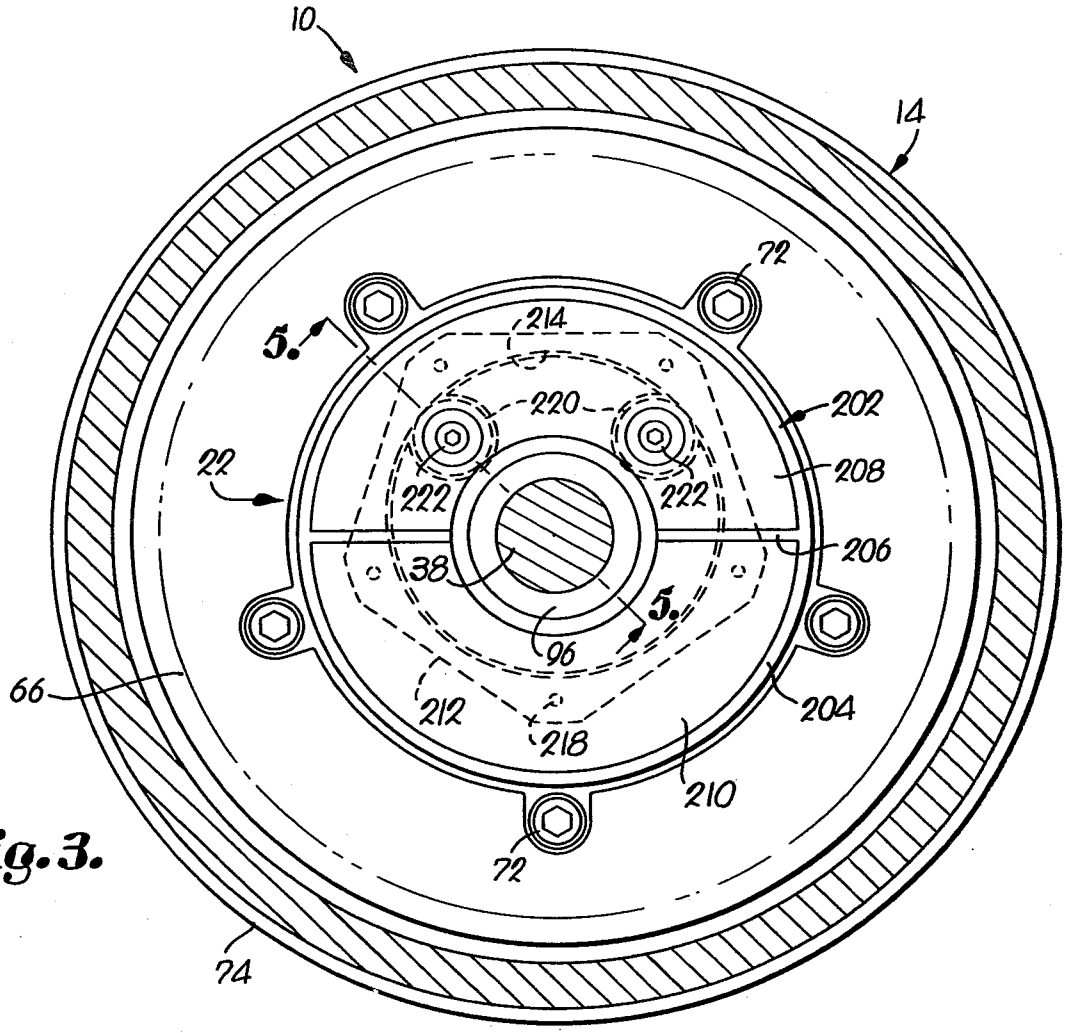
FIG. 3 is a sectional view taken along line 3—3 of FIG. 1.
Figure 5:
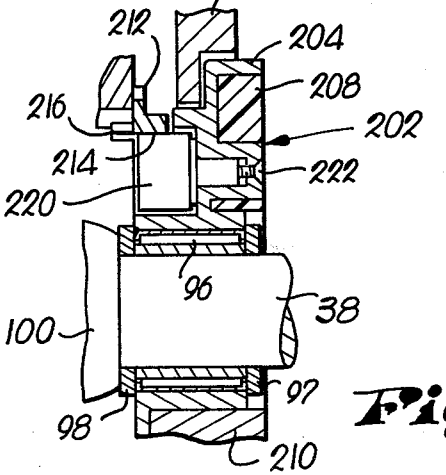
FIG. 5 is a fragmentary view in partial vertical section taken along line 5—5 of FIG. 3 and illustrating certain of the details of the counterbalancer mounting assembly.

Referring specifically to FIGS. 1, 3 and 5, this mounting arrangement will be described. The mounting structure includes a somewhat pentagonally shaped ring 212 presenting an inner, smooth, laterally extending, circular cam face 214 as well as five circumferentially spaced mounting tabs 216 (see FIG. 2) which extend into opening 48 of orbiter 18 and abut the periphery of the opening 48 between the spaced apart bearing areas 112. Screws 218 are employed for securing the ring 212 to the orbiter for movement therewith. A pair of rotatable cam followers 220 are mounted by means of screws 222 to the counterbalancer member 202 at the region of the lightweight portion thereof. These cam followers are engaged by the cam face 214 of ring 212 during movement of the latter with orbiter 18, so as to maintain the counterbalancer in its proper position relative to the orbiter at all times.

Operation

In the following discussion, the operation of device 10 as a fluid motor will be described. In such a case, the plate 24 is rigidly secured to a base such as a support 224 by means of cap screws 226 threaded into the plate bores 30. In addition, a pressurized fuel inlet line is operatively coupled to port 32, whereas a fluid exhaust line is coupled to port 34. These lines are in turn connected to a remote fluid pump (not shown). Further, a conduit may typically be attached to fluid drain port 36, this conduit being connected to a remote sump.

As those skilled in the art will readily appreciate, the above described structure in connection with frame 12, orbiter member 18 and valve assembly 20 includes various elements which define a continuous fluid circuit for fluid input and fluid output to and from the fluid displacement piston and cylinder assemblies 134. Briefly, for each such assembly 134, the circuit includes the fluid inlet port 32, bore 52, annular zone 54, the associated finger-like passageway 58 and opening 62, the bores 176 provided in the opposed, associated valve blocks 152, passageway 130 through member 18, slot 124 and bore 122, passageway 132, the bores 178 in the valve blocks, passageway 60, annular zone 57, bore 56, and finally outlet port 34.

During operation of device 10 as a motor, fluid under pressure is delivered into the fluid circuit through inlet port 32, bore 52, zone 54, the passageways 58, openings 62, and bores 176 and cavities 170 of the associated valve blocks 152. At this point, depending upon the positions of slot 124 relative to cavities 170, the fluid can pass into the slots 124 and bores 122, or be blocked from such passage. In the case of a valve in a pressure or input mode, the fluid passes through the slot 64 and into bore 122. In all events however, the fluid does pass through passageways 130 and into the cavities 170 and bores 176 of the opposed valve bodies on the opposite side of the member 18 for independent pressure equalization or compensation purposes. Similarly, the fluid passes from slot 124 into the cavities 174 of the opposed blocks, and the passageways 184 and depressions 156 in communication therewith, in order to provide additional pressure compensation and to urge the exposed valve bodies toward the orbiter under equal but opposite pressure. In the case of the first mentioned possibility, i.e., when the pressurized fluid flows through slot 124 and into bore 122, such fluid then passes into displacement chamber 148, exerting a force to move the inner member 142 radially outwardly. This has the effect of forcing the adjacent portion of the member 18 toward and into meshing, driving engagement with ring gear teeth 76, so as to impart rotary movement to the hub assembly 14. FIG. 4 illustrates the position of member 18 and of the associated, opposed valve blocks during such a pressure input sequence.

Simultaneously with the filling of one or more of the displacement chambers 148 with pressurized fluid as described, fluid is being exhausted from chambers 148 remote from those receiving the pressure input. Referring to FIG. 2, it will be seen that the valving arrangement at approximately the ten o'clock position is receiving a pressure input, whereas the valve at approximately five o'clock is in its exhaust cycle with slot 124 in communication only with the exhaust side of the dual body valve. The exhaust cycle is the reverse of that described above, i.e., fluid passes from the displacement chamber 148 through the bore 122 and slot 124 into the cavity 172, bore 178, opening 64, passage 60, annular zone 57, bore 56 and outlet port 34. In addition, the bore 132 is in constant communication with the cavities 172 forming a part of the opposed blocks 152, so as to maintain the desired individual pressure compensation; and likewise fluid passes from the slot 124 to the cavities 174, and their associated passageways 184 and depressions 156, so that the bodies 152 are subjected to equal but oppositely directed pressure forces.

The neutral position of a valve assembly is depicted in FIG. 2 at the twelve o'clock position, where the slot 124 is not in communication with either of the cavities 170 or 172, but only the opposed cavities 174.

It will thus be appreciated that the fluid displacement chambers 148 are progressively filled and exhausted with hydraulic fluid by virtue of the disposition of the slots 124 relative to spaced apart sets of valve blocks 152; moreover, by virtue of this action, the member 18 is urged or orbit continually while being supported and confined to its proper orbital path by the eccentric bushings 116 and related structure. As the member 18 orbits, the teeth 108 thereon "walk" around the teeth 76 on ring gear portion 74, causing the latter to rotate with respect to the orbiting member 18 and shaft 38. Rotational power is thus derived from device 10, operating as a motor, by suitable mechanical coupling with the studs 84 on hub assembly 14. Of course, if it is desired to reverse the rotational output, it is only necessary to reverse the direction of fluid flow through the motor, and all other operational sequences remain the same.

If it is desired to employ device 10 as a pump, the operation is essentially the same, except that mechanical rotative power is applied to hub assembly 14 to turn the latter, causing the member 18 to orbit under the constraint of the eccentrics 116, by virtue of the "walking" relationship between the epicyclic gear teeth 76, 108. As the member 18 is thus moved in an orbital path, the individual displacement chambers 148 are progressively placed in a fluid suction or fluid exhausting condition such that fluid may be pumped from external line through inlet port 32, thence through the fluid paths already traced, but in the opposite direction, for delivery to an output line coupled with port 34. Here again, the pumping action of device 10 is reversible, if desired, merely by reversing the direction of rotation in which the hub assembly 14 is driven.

During operation of device 10 either as a motor or as a pump, the above described constructional features of the valving assembly, piston and cylinder assemblies, and counterbalancing mechanism come into play.

The valving arrangement of the present invention, which provides a pair of independently shiftable valve bodies in opposed relationship to the member 18 at each valving location, serves to independently compensate the three pressures experienced by each slot 124 during the orbital motion of member 18, i.e., the pressures in cavities 170, 174 and 172. Such compensation stems from the fact that the lateral pressure loadings on the member 18 are balanced (through the use of opposed shiftable valve bodies having respective fluid chambers in constant fluid communication with one another), so that the net lateral loading on member 18 is essentially zero at all times. Also, it will be appreciated that this arrangement produces three separate, independent and balanced loadings at each valving location, corresponding to neutral, input and exhaust phases. In addition, by virtue of the fact that the member 18 is floating axially between respective, individually shiftable pairs of valve bodies, the pressure compensation and floating at any given valve location is independent of the compensation and floating at any other such location.

As explained hereinabove, the construction of the piston and cylinder assemblies 134 is such that an effective seal is provided at both ends of the assemblies by means of a net pressure force developed with the introduction of pressurized hydraulic fluid into the chambers 148.

It will also be observed that the mechanical components of the piston and cylinder assemblies carry little if any load during operation. Rather, the load is carried through the column of hydraulic fluid created within each assembly. The spherical or frustospherical configuration of the ends of the assemblies 134, and the mating surfaces on orbiter and ring 100, permits the assemblies to "rock" during operation in order to maintain proper alignment. Such self-alignment is in all planes and virtually eliminates side thrusts. At the same time, the preferred assembly configuration and "rocking" operations lessens costs because critical manufacturing tolerances are eliminated.

Finally, the counterbalancing mechanism provides an unbalance which is exactly equal to the unbalance attributable to the orbiting member 18, but with the centers of gravity of the orbiter and counterbalancer being 180 degrees out of phase. Accordingly, the counterbalancer produces a centrifugal force equal, but in an opposite direction, to the centifugal force produced by orbiter 18. In this fashion the net centrifugal force derived from operation of device 10 is essentially zero and vibrations are in large measure eliminated.

I claim:

1. In an energy translation device of the type including a member shiftable along a defined path of travel and presenting a pair of opposed faces, a plurality of fluid displacement assemblies operatively associated with said member, and means for input and output of hydraulic fluid to and from said assemblies including hydraulic fluid valving apparatus for said displacement assemblies, the improvement comprising:

a pair of opposed, cooperating, apertured valve bodies located adjacent each of said displacement assemblies and respectively disposed proximal to said opposed member faces and in communication with the adjacent displacement assembly;

means mounting each of said bodies for movement thereof toward and away from said member and independently of any such movement of any other body;

structure interconnecting the opposed bodies of each respective pair of bodies in pressure-communicating relationship; and actuation means associated with each of said bodies and operably connected to the adjacent interconnecting structure for urging each pair of said opposed bodies toward said member with equal but oppositely directed forces.

2. In an energy translation device:

a pair of elements, at least one of the elements being relatively movable with respect to the other;

means supporting said elements for relative movement therebetween;

a member interposed between said elements and presenting a pair of opposed faces;

means supporting said member for predetermined movement thereof relative to said elements;

fluid displacement means operably coupling said member with one of said elements at at least three spaced apart zones of said member;

transmission means operably coupling said member to said other element;

pressure compensating means, comprising a separate pair of opposed, cooperating bodies located adjacent each of said zones respectively, each body of each pair thereof being disposed proximal to one of said opposed member faces;

means supporting each of said pairs of bodies for independent movement thereof toward and away from said member and independent of such movement of the remaining pairs of said bodies; and individual fluid pressure operated actuation means associated with each of said bodies of each pair thereof for urging the bodies toward said member;

means for interconnecting the actuation means of the bodies making up each respective pair thereof in pressure communicating relationship whereby said bodies of each respective pair thereof are urged toward said member with equal and oppositely directed forces; and means defining a fluid circuit operatively coupled to said fluid displacement means and said actuation means for fluid input and output to and from said displacement means, and for operation of said actuation means, during operation of said device.

3. The device as set forth in claim 2, said body supporting means comprising elongated pin means, and apertures in said body slidably receiving said pin means.

4. The device as set forth in claim 2, said one element being a stator, and said other element being a rotor.

5. The device as set forth in claim 2, said transmission means comprising interengaging epicyclic gear means having cooperating tooth means on said member and said other element, said tooth means on the member having a lesser number of teeth than the tooth means on said other element.

6. The device as set forth in claim 2, said body supporting means including structure for independent movement of each of said bodies respectively.

7. The device as set forth in claim 2, said member supporting means including structure for guiding said member along an orbital path, and for allowing lateral movement of the member.

8. The device as set forth in claim 1, said fluid circuit defining means comprising:

structure defining a number, equal to the number of said zones, of sets of fluid passages in said one element, each of said sets including a fluid input passage and a fluid output passage, and corresponding fluid input and output openings in the face of said one element proximal to said member and in communication with the corresponding passages.

9. The device as set forth in claim 8, said fluid displacement means comprising:

structure defining a fluid displacement chamber coacting between said member and said one element at each of said zones and which is related to a corresponding set of said openings;

a displaceable body movable in response to a change in fluid pressure within said chamber; and means for separately and cyclically communicating the input and output openings of each of said sets with the related displacement chamber during said predetermined movement of said member.

10. The device as set forth in claim 2, each of said bodies and said acutation means comprising:

structure defining at least one cavity in the surface of the body adjacent the associated member face, said cavity-defining structure and said associated member face cooperatively defining at least one inboard chamber presenting a first effective pressure reactive area oriented for urging said body away from said member when the chamber is filled with pressurized fluid;

means defining a corresponding closed depression in the body remote from said surface and in general opposition to said chamber, said depression presenting a second effective pressure reactive area oriented for urging said body toward said member when the depression is filled with pressurized fluid; and means defining a duct communicating said corresponding depression and cavity for maintaining the same fluid pressure conditions within the depression and chamber, said second effective area being greater than said first effective area whereby the net pressure-derived force acting on said body urges the body toward said member.

11. The device as set forth in claim 10, said actuation means including at least one fluid passageway through said member adjacent each of said zones for communicating the inboard chambers of the opposed bodies of each pair thereof.

12. The device as set forth in claim 10, there being three separate cavities and corresponding depressions and ducts in said body, and three fluid passageways through said member adjacent each of said zones for communicating the three inboard chambers of the opposed bodies of each pair thereof.

13. The device as set forth in claim 10, there being lands on said surface projecting toward said member.

14. In an energy translation device:

a pair of elements, at least one of the elements being relatively movable with respect to the other;

means supporting said elements for relative movement therebetween;

a member interposed between said elements and presenting a pair of opposed faces;

means supporting said member for predetermined movement thereof relative to said elements;

fluid displacement means operably coupling said member with one of said elements at at least three spaced apart zones of said member;

transmission means operably coupling said member to said other element;

pressure compensating means, comprising a pair of opposed, cooperating bodies located adjacent each of said zones and respectively disposed proximal to said opposed member faces;

means supporting said bodies for movement thereof toward and away from said member; and fluid pressure operated actuation means associated with said bodies for urging the bodies toward said member and exerting desired forces thereagainst, said actuation means comprising structure defining three separate cavities in the surface of the body adjacent the associated member face, said cavity-defining structure and said associated member face cooperatively defining three inboard closed chambers presenting a first effective pressure reactive area oriented for urging said body away from said member when the chamber is filled with pressurized fluid;

means defining three corresponding closed depressions in the body remote from said surface and in general opposition to said chambers, said depressions presenting a second effective pressure reactive area oriented for urging said body toward said member when the depressions are filled with pressurized fluid; and means defining ducts communicating said corresponding depressions and cavities for maintaining the same fluid pressure conditions within corresponding depressions and chambers, said second effective area being greater than said first effective area whereby the net pressure-derived force acting on said body urges the body toward said member; and means defining a fluid circuit operatively coupled to said fluid displacement means and said actuation means for fluid input and output to and from said displacement means, and for operation of said actuation means, during operation of said device, said fluid circuit defining means comprising structure defining a number, equal to the number of said zones, of sets of fluid passages in said one element, each of said sets including a fluid input passage and a fluid output passage, and corresponding fluid input and output openings in the face of said one element proximal to said member and in communication with the corresponding passages, said fluid input opening being in communication with another of said depressions, and with the adjacent displacement chamber being in communication with the remaining depression.

15. In a valve assembly;

a pair of opposed, spaced apart valve blocks;

means mounting said blocks for movement thereof toward and away from each other;

structure defining three separate cavities associated with each block, three separate depressions in each block and respectively in generally opposed relationship to said cavities, and three separate ducts in each block communicating opposed cavities and depressions, said cavities presenting first, respective, effective pressure reactive areas oriented such that, when the cavities are filled with pressurized hydraulic fluid, said blocks are urged apart, said depressions presenting second, respective, effective pressure reactive areas oriented such that, when the depressions are filled with pressurized hydraulic fluid, said blocks are urged together, means defining three separate fluid communications between opposed cavities associated with said blocks for communicating and equalizing pressure between said blocks, said second areas being larger than the corresponding first areas such that said blocks are urged together with equal and oppositely directed forces when said blocks are exposed to elevated pressures; and means for slidably sealing said depressions relative to associated adjacent structure.

16. The valve assembly as set forth in claim 15, there being a shiftable member located between said valve blocks, said means defining said fluid communications between opposed cavities comprising structure defining three separate fluid passageways through said member.

17. The valve assembly as set forth in claim 15, said cavities being located adjacent the proximal opposed surfaces of said blocks, said depressions being located in surfaces of said blocks remote from and opposed to said cavities.

18. In an energy translation device of the type including frame structure, a member shiftable along a defined path of travel and presenting a pair of opposed faces, a plurality of fluid displacement assemblies operatively associated with said member, and means for input and output of hydraulic fluid to and from said assemblies including, for each assembly, a fluid input passageway and a fluid output passageway, the improvement which comprises hydraulic valve apparatus forming a part of said input and output means, said valve apparatus comprising:

a pair of opposed, cooperating valve bodies located adjacent each of said displacement assemblies and respectively disposed proximal to said opposed member faces;

structure defining three cavities adjacent the surfaces of each said bodies closest said member and presenting respective, first, effective pressure reactive areas oriented for urging said bodies away from the member when the cavities are filled with pressurized hydraulic fluid;

structure defining three depressions in said body respectively associated with and in general opposition to said cavities, said depressions presenting respective, second, effective pressure reactive areas oriented for urging said bodies toward said member, when the depressions are filled with hydraulic fluid, said second areas being greater than the corresponding opposed first areas;

means defining three ducts in each of said bodies respectively communicating opposed, associated cavities and depressions;

means defining three separate fluid passageways through said member and communicating the opposed faces thereof, one of said member fluid passageways being in communication with the adjacent fluid displacement assembly, one of the bodies of each pair thereof being oriented with one of said depressions in communication with the adjacent input passageway, another of said depressions in communication with the adjacent output passageway, the cavity associated with said one depression being in communication with a first of said member passageways, the cavity associated with the other of said depressions being in communication with a second of said member passageways, and the remaining cavity being in communication with said one member fluid passageway, the other of said bodies in each pair thereof being oriented with three cavities thereof respectively in communication with said three member fluid passageways; and means for slidably sealing between each said depressions and said frame structure.

* * * * *